US010418691B2

(12) United States Patent
Biscontini et al.

(10) Patent No.: US 10,418,691 B2
(45) Date of Patent: Sep. 17, 2019

(54) ANTENNA DEVICE FOR A BASE STATION ANTENNA SYSTEM

(71) Applicant: HUAWEI TECHNOLOGIES CO., LTD., Shenzhen, Guangdong (CN)

(72) Inventors: Bruno Biscontini, Munich (DE); Vincent Mallepeyre, Munich (DE); Yingtao Luo, Shenzhen (CN)

(73) Assignee: HUAWEI TECHNOLOGIES CO., LTD., Shenzhen, P.R. (CN)

( * ) Notice: Subject to any disclaimer, the term of this patent is extended or adjusted under 35 U.S.C. 154(b) by 155 days.

(21) Appl. No.: 15/493,347

(22) Filed: Apr. 21, 2017

(65) Prior Publication Data

US 2017/0222306 A1 Aug. 3, 2017

Related U.S. Application Data

(63) Continuation of application No. PCT/EP2014/072897, filed on Oct. 24, 2014.

(51) Int. Cl.
*H01Q 1/24* (2006.01)
*H01Q 9/26* (2006.01)
(Continued)

(52) U.S. Cl.
CPC ..... *H01Q 1/246* (2013.01); *H01Q 9/26* (2013.01); *H01Q 9/285* (2013.01); *H01Q 21/26* (2013.01); *H01Q 25/001* (2013.01)

(58) Field of Classification Search
CPC ..... H01Q 1/246; H01Q 25/001; H01Q 21/26; H01Q 9/26; H01Q 9/285
(Continued)

(56) References Cited

U.S. PATENT DOCUMENTS 7,053,852 B2 * 5/2006 Timofeev ..... H01Q 1/246 343/793
2004/0140942 A1 7/2004 Gottl
2006/0273865 A1 12/2006 Timofeev et al.
(Continued)

FOREIGN PATENT DOCUMENTS

CN 103441324 A 12/2013
CN 103682631 A 3/2014
(Continued)

OTHER PUBLICATIONS

International Search Report, dated Jun. 29, 2015, in International Application No. PCT/EP2014/072897 (3 pp.).
(Continued)

*Primary Examiner* — Khai M Nguyen
(74) *Attorney, Agent, or Firm* — Staas & Halsey LLP

(57) ABSTRACT

An antenna device is described. The antenna device 100 comprises at least two antenna elements each of comprising a first radiating element 110 and a corresponding second radiating element 120. The second radiating element 120 extends in a height direction along a common center axis A from a foot of the antenna device 100 to its corresponding first radiating element 110. The first radiating element 110 extends in a length direction outwards from the common center axis A. The length of the first radiating element 110 defines the maximum supported wavelength. Furthermore, each first radiating element 110 has a greater length than its width and each first radiating element 110 is electrically coupled to its corresponding second radiating element 120 along the length direction, so that the second radiating element 120 can contribute to the smaller wavelengths.

14 Claims, 15 Drawing Sheets

(51) Int. Cl.
*H01Q 9/28* (2006.01)
*H01Q 21/26* (2006.01)
*H01Q 25/00* (2006.01)

(58) Field of Classification Search
USPC ..... 343/797, 798, 806
See application file for complete search history.

(56) References Cited

U.S. PATENT DOCUMENTS

| | | | | |
|---|---|---|---|---|
| 2011/0043425 | A1 | 2/2011 | Timofeev et al. | |
| 2012/0299790 | A1 | 11/2012 | Bounpraseuth | |
| 2014/0028516 | A1* | 1/2014 | Semonov | H01Q 21/26 343/798 |
| 2017/0222306 | A1* | 8/2017 | Biscontini | H01Q 1/246 |

FOREIGN PATENT DOCUMENTS

| | | | |
|---|---|---|---|
| DE | 202004008770 | U1 | 9/2004 |
| WO | 03/065505 | A1 | 8/2003 |

OTHER PUBLICATIONS

International Search Report dated Jul. 3, 2015 in corresponding International Patent Application No. PCT/EP2014/072897.

Seong-Youp Suh et al. "A Novel Low- profile, Dual- polarization, Multi-band Base-station Antenna Element—the Fourpoint Antenna" IEEE, 2004.

Office Action, dated Dec. 26, 2018, in Chinese Application No. 201480082812.3 (9 pp.).

* cited by examiner

VSWR for ±45° Polarization

Antenna arrangement

ANTENNA DEVICE FOR A BASE STATION ANTENNA SYSTEM

CROSS-REFERENCE TO RELATED APPLICATIONS

This application is a continuation of International Application No. PCT/EP2014/072897, filed on Oct. 24, 2014, the disclosure of which is hereby incorporated by reference in its entirety.

TECHNICAL FIELD

The present application relates to an antenna device for a base station antenna system.

BACKGROUND

The continuous increase of data-traffic demand challenges and drives the mobile telecommunication industry to introduce new frequency bands, standards and radio access technologies e.g. MIMO, beamforming etc. From an antenna point of view that means multiple antenna systems which offer more agile beam possibilities. In order to achieve more agile beam antennas, phase and amplitude have to be set in real time and in a flexible way. This leads to so called Active Antenna Systems, AAS, which means integrating radio transceiver units, RRU, with base station antenna systems. This integration leads to highly complex systems and strongly influences the antenna form factor which is fundamental for commercial field deployment. Replacing traditional antennas with AAS or simply obtaining new site permissions if the form factor of the antenna is not similar to traditional antennas is a time consuming and hard task to be fulfilled for the operators, and this is also valid for traditional passive base station antenna systems.

As it is well known, ultra broad band base station antenna systems typically operate in the 698-960 MHz ("Low Band") and 1.7-2.7 GHz ("High Band") spectrum which includes most cellular network frequency bands used today. A relative bandwidth of the ultra broad band base station antenna systems can be calculated by the equation:

$$\text{The relative bandwidth}=2*(f\text{max}-f\text{min})/(f\text{max}+f\text{min}),$$

and is supposed to be greater than 30%.

On the one hand, a base station antenna element must have a sufficient depth for supporting the lowest frequency of the cellular network frequency bands and achieving a relative bandwidth which is greater than 30%. In the meanwhile, with the growing demand for a deeper integration of antennas with Radios, as e.g. in AAS, it is very important to reduce the dimensions of ultra broad band antennas without compromising the antenna's key performance.

In view of the above, one of the dominant limiting technological factors for reducing the overall antenna dimensions is the height of the lower band radiating element which strongly influences the overall antenna depth. Significantly reducing the antenna height means to strongly simplify the overall deploying process of AAS and traditional passive antenna systems.

Conventional base station antennas, do not present any solutions for reducing the lower frequency antenna element depth during supporting the lowest frequency of the cellular network frequency bands and achieving a relative bandwidth which is greater than 30%.

SUMMARY

In view of the above-mentioned disadvantages and problems, the present application aims to improve the state of the art. In particular, the object of the present application is to provide an antenna device, which provides a better compromise between a size of the antenna device and an achievable bandwidth of the antenna device. The present application also intends to enable a simple manufacture of the dipole of the antenna device. The present application also aims for an economical solution by enabling a high degree of automation in the mass production process.

The above-mentioned object of the present application is achieved by the solution provided in the enclosed independent claims. Advantageous implementations of the present application are further defined in the respective dependent claims. In particular, an idea of the present application is to provide a new base station antenna radiating element class which compensates the height reduction effect.

Embodiments of the present application provide an antenna device comprising at least two antenna elements, each antenna element comprising a first radiating element and a corresponding second radiating element; wherein each second radiating element extends in a height direction along a common center axis from a foot of the antenna device to its corresponding first radiating element; wherein each first radiating element extends in a length direction outwards from the common center axis; wherein each first radiating element has a greater length than its width; and wherein each first radiating element is electrically coupled to its corresponding second radiating element along the length direction.

The antenna device maintains ultra broad band characteristics, particularly a relative bandwidth greater than 30%, and reduces the overall height (with respect to the ground plane) to be lower than 0.15 $\lambda$max. The largest dimension of the first radiating element defines the maximum wavelength relating to the lowest frequency. The second radiating element of the antenna device contributes to the smaller wavelengths. This enables the radiating element to support the wished bandwidth.

In a first implementation form of the antenna device according to the present application, each of the first radiating elements has a length which is at least two times greater than its width.

In a second implementation form of the antenna device according to the present application as such or according to the first implementation form of the present application, each of the second radiating elements is planar.

That means, the second radiating element can be manufactured by processing a planar metal sheet.

In a third implementation form of the antenna device according to the present application as such or according to any one of the preceding implementation forms of the present application, each of the first radiating elements comprises a strip portion which extends outwards from the common center axis in the length direction and at least one bent portion which extends in an angle $\varphi$ to the length direction, wherein $10° \leq \varphi \leq 170°$. It is advantageous to manufacture the first radiating element and the second radiating element out of one metallic sheet without the need for soldering, and thus enable a high degree of automation in the mass production process.

In a fourth implementation form of the antenna device according to the present application as such or according to any one of the preceding implementation forms of the present application, for each second radiating element a length of the second radiating element is smaller at the foot as the length at its corresponding first radiating element.

In a fifth implementation form of the antenna device according to the present application as such or according to any one of the preceding implementation forms of the present application, each second radiating element comprises a first edge extending from the foot at least partially along the height direction to a first end of the second radiating element, the first end being arranged comparatively close to the common center axis and being coupled to the corresponding first radiating element wherein each second radiating element comprises a second edge extending from the foot to a second end of the second radiating element, the second end being arranged comparatively distant from the common center axis and being coupled to the corresponding first radiating element. Thereby, the second radiating elements can contribute to the smaller wavelengths.

In a sixth implementation form of the antenna device according to the present application as such or according to any one of the preceding implementation forms of the present application, each first radiating element of the antenna element comprises a bending edge extending in the length direction and electrically connecting the first radiating element of the antenna element to the corresponding second radiating element of the antenna element.

By using bending edges between the first radiating elements and their corresponding second radiating elements, each antenna element can be built based on a single piece, e.g. by using bent metal sheet technology. Hence, there is no need for soldering the first and second radiating elements together as they are already connected to each other by the bending edge between them.

In a seventh implementation form of the antenna device according to the present application as such or according to any one of the preceding implementation forms of the present application, each second radiating element comprises an opening extending in the length direction from a first connection point between the second radiating element and the corresponding first radiating element to a second connection point between the second radiating element and the corresponding first radiating element; wherein an area of the opening is as at least as large as an area of a portion of the first radiating element, the portion extending in the length direction from the first connection point to the second connection point and in a width direction from the bending edge to an edge of the corresponding first radiating element. By designing the opening in the second radiating element according to this definition, it can be achieved that the first radiating element can be bended out of the second radiating element.

In an eighth implementation form of the antenna device according to the present application as such or according to any one of the preceding implementation forms of the present application, each antenna element comprises an impedance transformer arranged at a connection point electrically coupling the first radiating element of the antenna element to the corresponding second radiating element of the antenna element. Accordingly, the impedance transformer is integrated into the antenna element and also helps to reach the required bandwidth.

In a ninth implementation form of the antenna device according to the present application as such or according to any one of the preceding implementation forms of the present application, each antenna element is formed in a single piece. Thereby, a high degree of flexibility of the use and the arrangement of the antenna elements can be achieved.

In a tenth implementation form of the antenna device according to the present application as such or according to any one of the preceding implementation forms of the present application, the antenna device further comprises an electrically conducting director element being arranged in the height direction above the first radiating elements and being supported by dielectric material arranged between the director element and the first radiating elements.

The director element can compensate the capacity to ground effect caused by the height reduction and in this way the director can also contribute to the broadband matching. The director element is not directly connected to ground. This is advantageous, since it introduces also an inductive component and the bandwidth performance of the radiating element can thus be significantly improved.

In an eleventh implementation form of the antenna device according to the tenth implementation form of the present application, the director element comprises per first radiating element of the antenna element a corresponding arm extending from the common center axis outwards in the same direction as the corresponding first radiating element.

In a twelfth implementation form of the antenna device according to the present application as such or according to any one of the preceding implementation forms of the present application, the two antenna elements form a first pair of antenna elements and a dipole of the antenna.

In a thirteenth implementation form of the antenna device according to the twelfth implementation form of the present application, the antenna device further comprises a second pair of antenna elements arranged around the common center axis and forming a second dipole of the antenna device.

In a fourteenth implementation form of the antenna device according the thirteenth implementation form of the present application, the pairs of said antenna elements are arranged such that the second radiation elements of a respective pair form a 180° angle and the second radiation elements of two different pairs form a 90° angle. The antenna device is thus composed by two dipoles which are orthogonally placed, with respect to their geometrical and\or phase center, and form a 90 degree angle. In this way they form a "cross-like" structure which supports the excitation of two orthogonal E-field polarizations. This achieves a bandwidth performance with VSWR<1.35 where the relative bandwidth is greater than 35%.

BRIEF DESCRIPTION OF DRAWINGS

The main aspect and implementation forms of the present application will be explained in the following description of specific embodiments in relation to the enclosed drawings, in which.

DETAILED DESCRIPTION OF EMBODIMENTS

Figure 1:
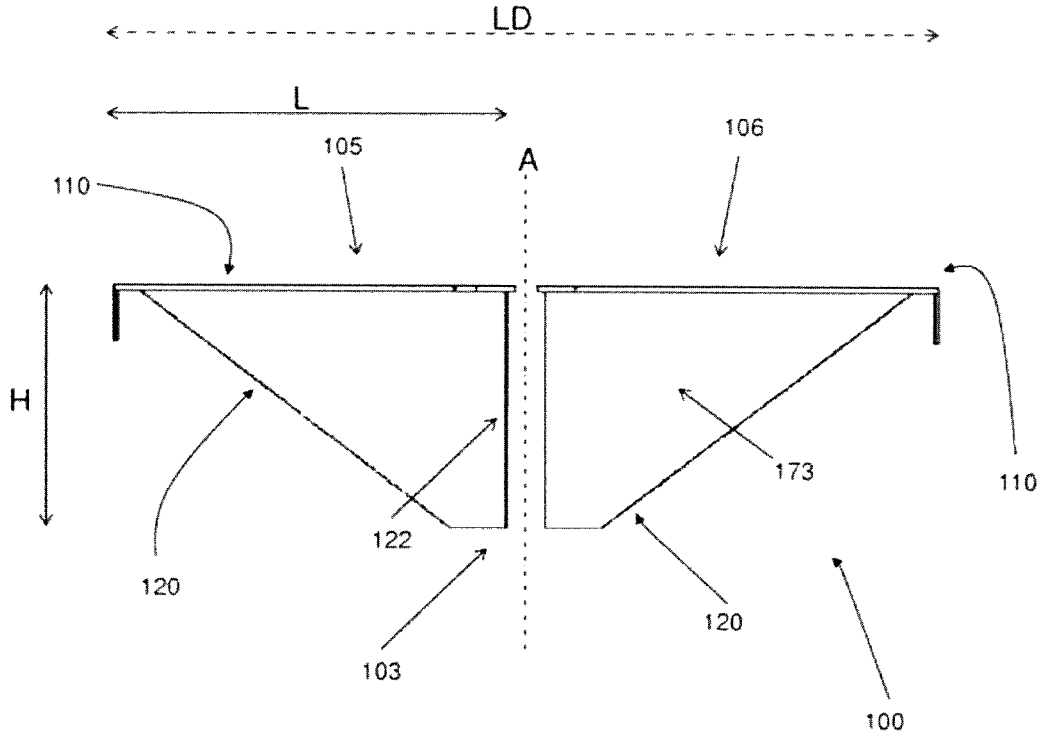
FIG. 1 shows a schematical view of an antenna device according to an embodiment of the present application.

FIG. 1 shows an antenna device 100 for a base station according to an embodiment of the present application. The antenna device 100 comprises at least two antenna elements 105 and 106 each of which comprises a first radiating element 110 and a corresponding second radiating element 120. The second radiating element 120 extends in a height direction along a common center axis A from a foot 103 of the antenna device 100 to its corresponding first radiating element 110. The first radiating element 110 and the second radiating element 120 are preferably made of a (single) metal sheet.

The first radiating element 110 extends in a length direction LD outwards from the common center axis A. The length L of the first radiating element 110 defines the maximum supported wavelength. Furthermore, each first radiating element 110 has a greater length L than its width W (FIG. 3) and each first radiating element 110 is electrically coupled to its corresponding second radiating element 120 along the length direction LD, so that the second radiating element 120 can contribute to the smaller wavelengths.

The major contribution of embodiments of the present application is to reduce the low-band radiating element height, and therefore the overall antenna height H of the antenna device 100 can be reduced by 20-30%, while keeping base station class performance, particularly keeping the relative bandwidth greater than 30%.

Compared to other ultra broad band antennas, the maximum distance of the radiating system to the reflector is reduced by 20-30%. An overall antenna height H below 0.15λMAX can be achieved where the λMAX is the wavelength of the lowest supported frequency.

Figure 4:
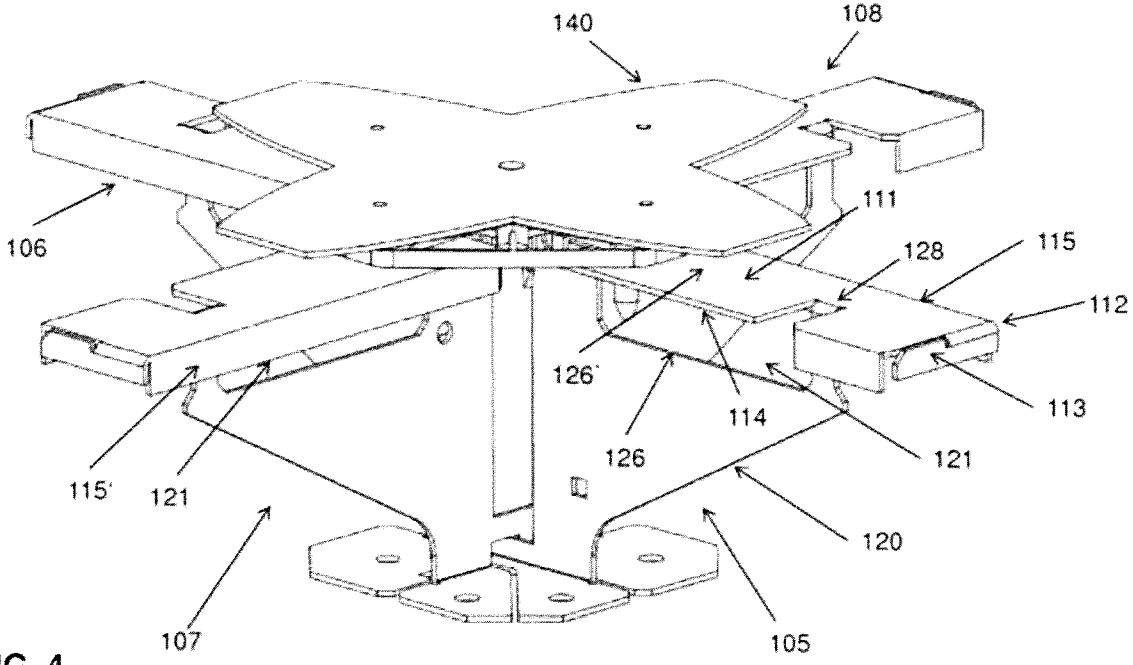
FIG. 4 shows a perspective view of the antenna device according to an embodiment of the present application.

As also illustrated in FIG. 4 which is a perspective view of the antenna device 100, each of the second radiating elements 120 may be planar which allows manufacturing the antenna device 100 from a single metal sheet.

Preferably, the first radiating elements 110 of different antenna elements 105, 106 respectively have the same shape and/or size. Similarly, the second radiating elements 120 of different antenna elements 105, 106 may respectively have the same shape and/or size.

Further, each of the first radiating elements 110 may comprise a strip portion 111 which extends outwards from the common center axis in the length direction and at least one bent portion 113, which extends in an angle φ between 10° and 170° to the length direction, at the outermost part 112 of the strip portion 111 of the first radiating elements 110. The bent portion 113 may be built by using bent metal sheet technique.

Preferably, a length L2 of the second radiating element 120 at the foot 103 is smaller as the length L1 at its corresponding first radiating element 110.

An edge 122 along the height direction H of the second radiating element 120 is arranged to be very close to the common center axis A. The first upper end 123 of the edge 122 is coupled to the corresponding first radiating element 110. Another edge 124 of the second radiating element 120 extends from the foot 103 to a second upper end 125 of the second radiating element 120. As shown in FIG. 1, the second upper end 125 of the second radiating element 120 is coupled to the corresponding first radiating element 110, and comparing with the first upper end 123, the second upper end 125 of the second radiating element 120 is arranged distant from the common center axis A.

Figure 2:
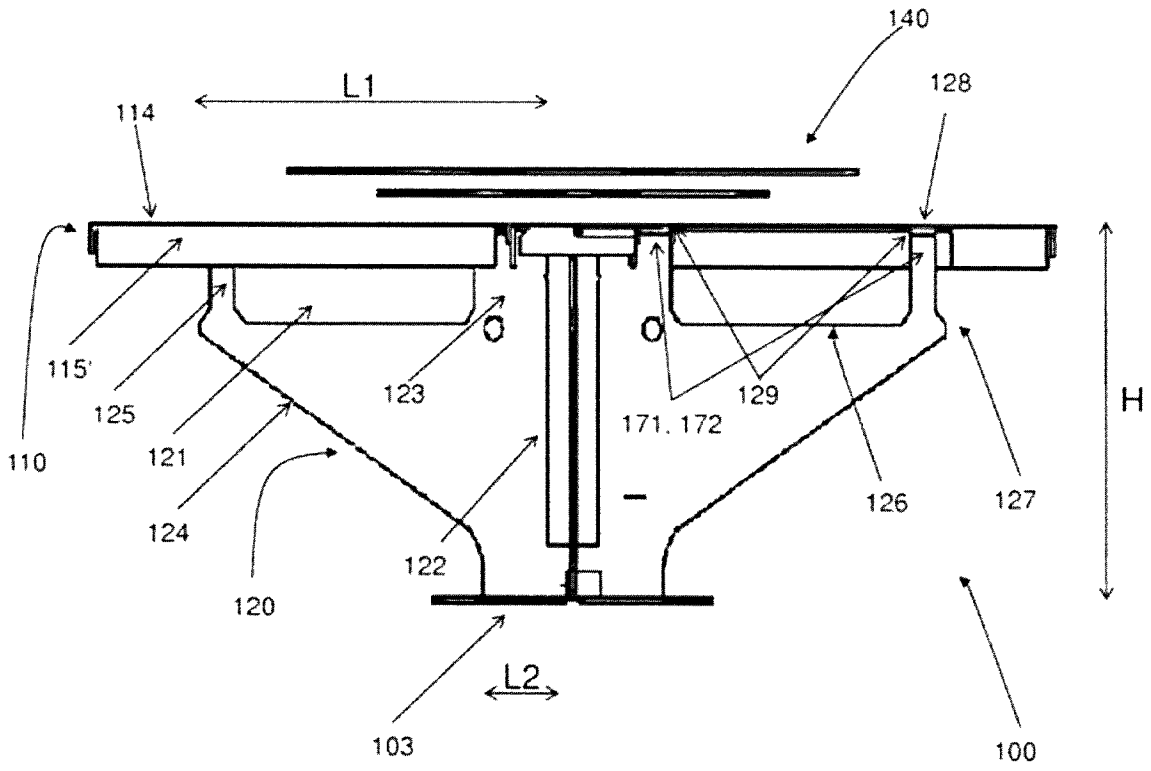
FIG. 2 shows a schematical view the antenna device according to an embodiment of the present application.

FIG. 2 shows a bending edge 114 of each first radiating element 110. The bending edge 114 extends in the length direction LD and electrically connects the first radiating element 110 of the antenna element to the corresponding second radiating element 120 of the antenna element.

The second radiating element 120 and the corresponding first radiating element 110 can be made out of a single metal sheet by cutting a U-shaped incision 126 in the upper part 127 of the second radiating element 120. The metal sheet formed the second radiating element 120 and the corresponding first radiating element 110 is bent along a bending edge 128 defined by two upper end points 129 of the U-shaped incision 126 in the second radiating element 120. As more clearly illustrated in FIG. 4 which is a perspective view of the antenna device, after the bending, the portion 126' above U-shaped incision 126 forms a part of the strip portion 111 of the corresponding first radiating element 110, and the second radiating element 120 comprises now an opening 121 in place defined by the U-shaped incision 126 and the bending edge 128. Thus, as illustrated in FIGS. 2 and 4, the first radiating element 110 and the second radiating element 120 of each antenna element can be formed in a single piece.

The opening 121 is arranged between the first and the second upper ends 123 and 125 of the second radiating element 120 and extends in the length direction LD from a first connection point 171 between the second radiating element 120 and the corresponding first radiating element 110 to a second connection point 172 between the second radiating element 120 and the corresponding first radiating element 110.

The area of the opening 121 is as large as an area of the portion 126' of the first radiating element 110 which corresponds to the U-shaped incision 126. Furthermore, the area of the opening 121 is larger than an area of the portion of the stripe portion of the first radiating element 110 from the first connection point 171 to the second connection point 172 and in a width direction from the bending edge 128 to the edge 114 corresponding to the U-shaped incision 126. Furthermore, an edge 115 opposite to the edge 114 forms another bending edge 115 of the first radiating element 110. Along this other bending edge 115 a further strip portion 115' of the first radiating element 110 extends along the length direction of the first radiating element 110 in this example in a 90° angle to the strip portion 111. According to further embodiments the angle between the further strip portion 115' and the strip portion 111 can be in a range >=10° and <=170°.

An important advantage is that the antenna elements can be built using bent metal sheet technology. This allows realizing the second radiating element 120 and the corresponding first radiating element 110 out of one single metallic sheet (without the need for soldering). Embodiments of the present application thus enable a highly degree of automation in the mass production process with all the advantages of the case.

Preferably, each of the second radiating elements 120 may have a substantial triangular portion 173 between its foot and its upper ends (cf. FIG. 1).

As shown in FIG. 4, a pair of antenna elements 105 and 106 forms a dipole of the antenna and two pairs of antenna elements 105, 106, 107 and 108 arranged around the common center axis. The two pairs of said antenna elements 105, 106, 107 and 108 are arranged such that the second radiation elements of a respective pair form a 180° angle and the second radiation elements of two different pairs form a 90° angle. That is to say, preferably, the two pairs of dipoles 105, 106, 107 and 108 are orthogonally or quasi-orthogonally arranged.

This allows to the dipole structure itself to maintain ultra broad band characteristics even reducing the overall height which respect to the ground plane<0.15 λmax. Indeed, the first radiating element 110, namely the largest dipole arm dimension, defines the maximum wavelength. The galvanically and/or capacitively connected second radiating element 120 gradually contributes to the smaller wavelengths. This enables the radiating elements 110 and 120 to support the wished bandwidth.

Figure 3:
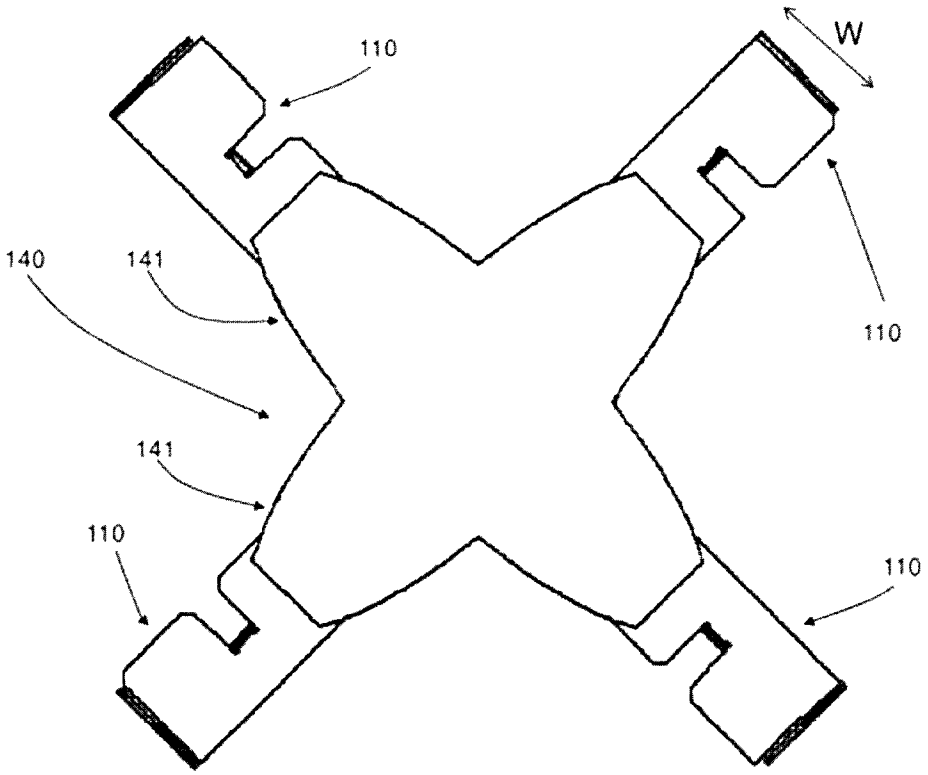
FIG. 3 shows a top view of the antenna device according to an embodiment of the present application.

As shown in FIGS. 2, 3 and 4, a director element system comprising one or more director elements 140 (e.g. Disk, cross, cylinders, ring etc.) is placed on the antenna elements (dipoles) 105, 106, 107 and 108. The function of the director element system is to compensate the capacity to ground effect generated by the height reduction and in this way contributing to the broadband matching.

The director element system is not directly connected to ground. This has the advantage to introduce also an inductive component and by this way has the clear advantage to significantly improving the radiating element bandwidth.

Figure 5:
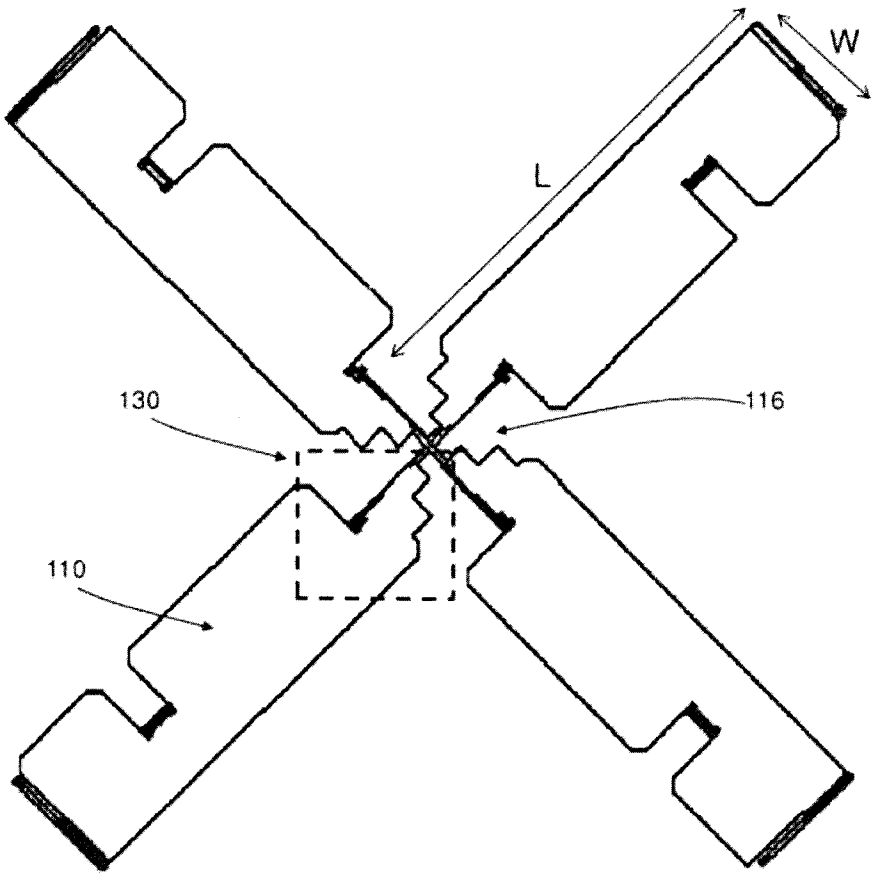
FIG. 5 shows a top view of an antenna device according to an embodiment of the present application comprising an impedance transformer.

As illustrated in FIG. 5, an impedance transformer 130 is integrated in the first radiating element 110 around the feed point 116. Each antenna element comprises an impedance transformer 130 arranged at the connection point 171 electrically coupling the first radiating element 110 of the antenna element to the corresponding second radiating element 120 of the antenna element.

It also can be seen from FIG. 5 that the length L of each of the first radiating elements 110 can be at least two times greater than the width W the first radiating elements 110.

Figure 6:
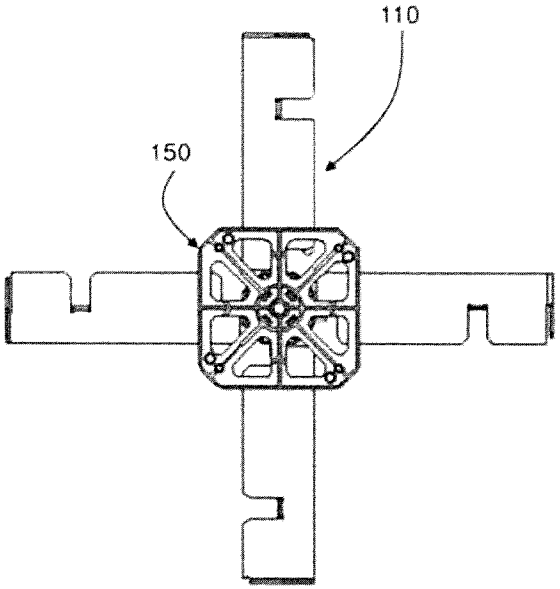
FIG. 6 shows the arrangement of the dielectric material.
Figure 7:
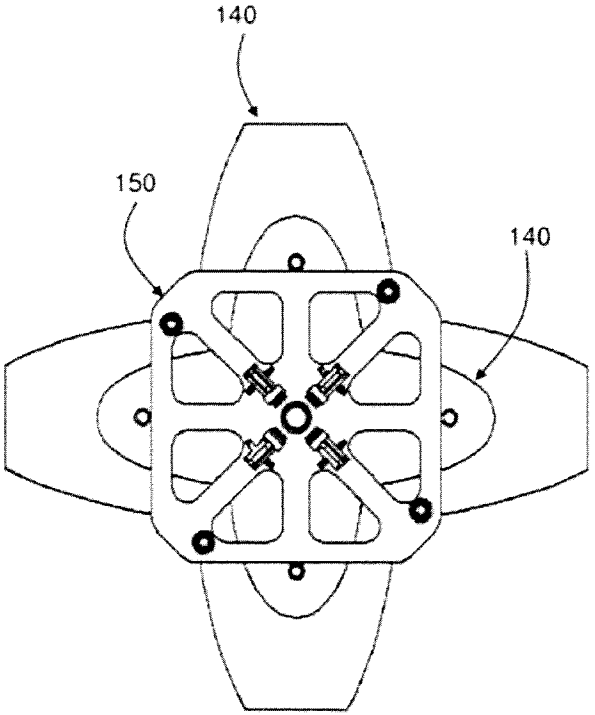
FIG. 7 shows another arrangement of the dielectric material.

The electrically conducting director element 140 is arranged in the height direction H above the first radiating elements 110 and being supported by dielectric material 150 arranged between the director element 140 and the first radiating elements 110. As shown in FIGS. 6 and 7, the additional dielectric material 150 is preferably placed e.g. between the 2 directors 140 and/or the directors 140 and the dipoles 105, 106, 107 and 108, and can be used for timing the bandwidth and as mechanical support for the antenna device 100.

The director element 140 comprises per first radiating element 110 of the antenna element a corresponding arm 141 extending from the common center axis outwards in the same direction as the corresponding first radiating element 110. Furthermore, at least in some examples, the director system is composed of 2 quasi elliptical orthogonal crosses as shown in FIG. 3.

Figure 8:
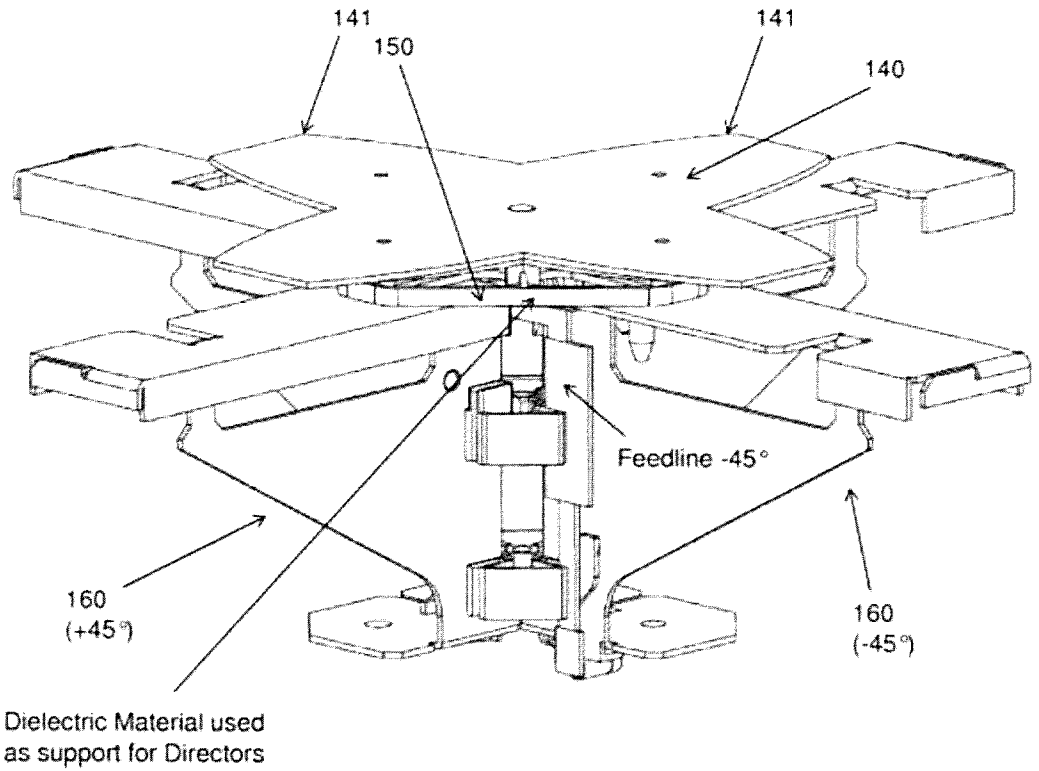
FIG. 8 shows a perspective view of the dipole according to an embodiment of the present application.

FIG. 8 shows a perspective view of the arrangement of the dipoles according to an embodiment of the present application.

Specially, a realization example of a dual polarized antenna device (e.g. a low band radiator) is shown in FIGS. 2 to 8. The antenna device is composed by 2 pairs of radiating elements, each pair forming a dipole, placed 90 degree orthogonal regarding the geometrical center (the common center axis A). The two dipoles form a "cross-like" structure which supports the excitation of 2 orthogonal E-field polarizations. In this realization example, a bandwidth performance (VSWR<1.35 @ relative bandwidth>35%) can be achieved. The second radiating elements 120 (dipole feet) are electrically connected to the first radiating elements 110 (the dipole arms). The mechanical and electrical material properties of the mounting system for the director 140 and the crosses formed by the dipoles shown in FIGS. 4 and 8 are chosen to optimize the bandwidth and stability performance.

Figure 9:
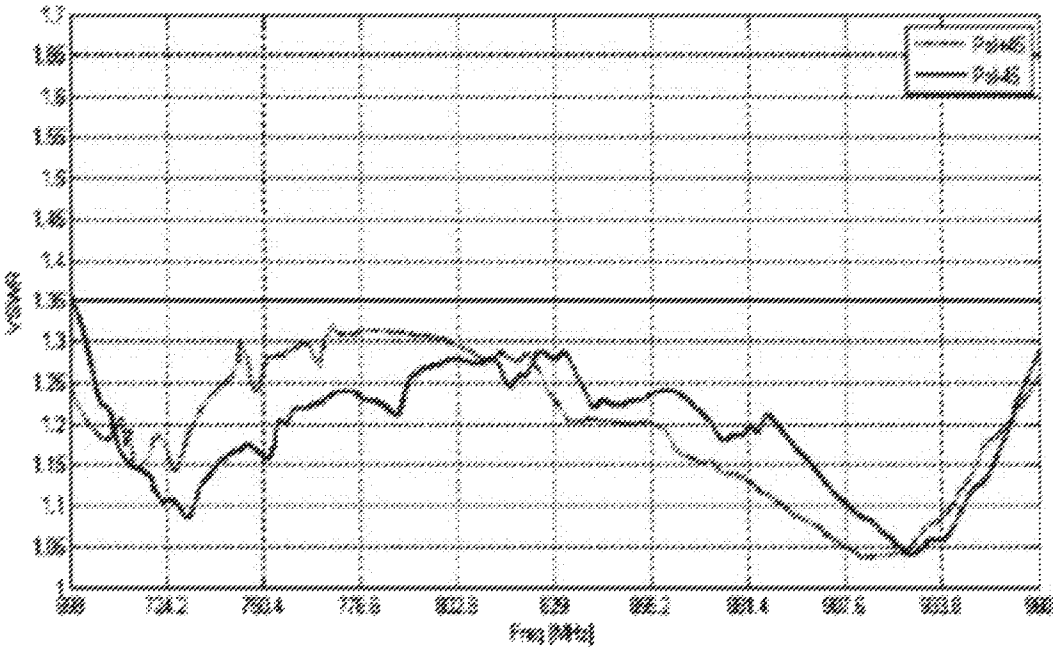
FIG. 9 shows the measurements of bandwidth performance.

In FIG. 9, it is shown by measurements that required bandwidth performance can be meet when even when reducing the height<40%.

Figure 10:
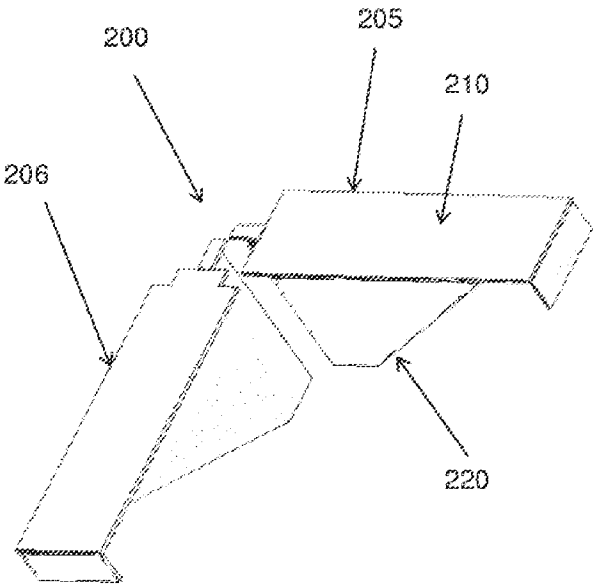
FIG. 10 shows a perspective view of the first and the second radiating element.

FIG. 10 shows another embodiment of an antenna device 200. Accordingly, two antenna elements 205 and 206, each of which comprises a first radiating element 210 and a second radiating element 220, are arranged such that the second radiating elements of the two antenna elements form a 90° angle.

Figure 11:
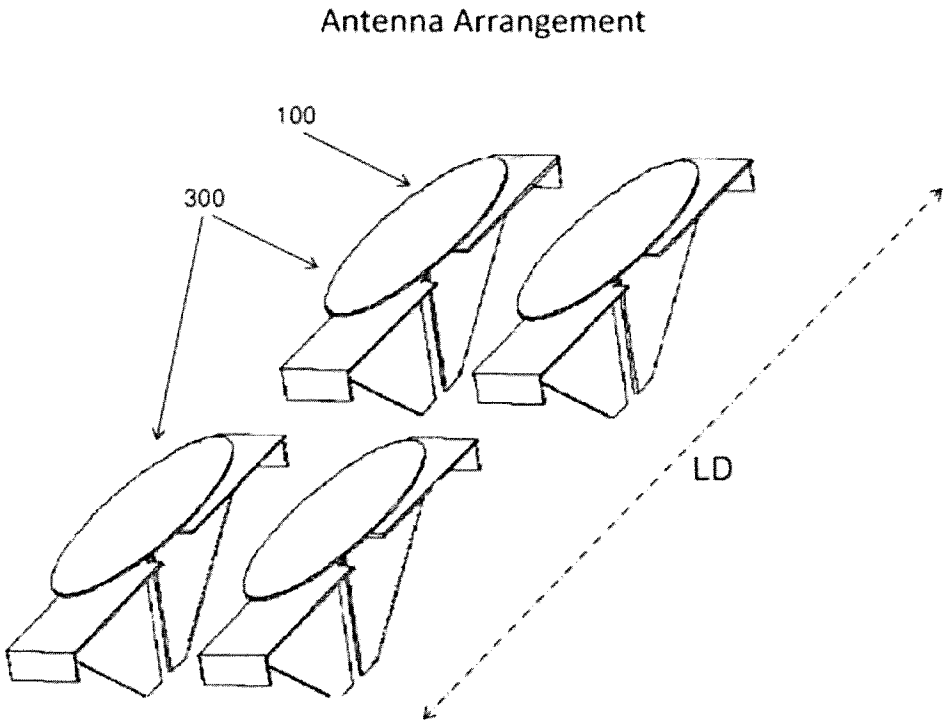
FIG. 11 shows au arrangement of antenna devices according to an embodiment of the present application.

FIG. 11 shows an arrangement of several antenna devices 100. Accordingly, at least two antenna devices 100 are placed in a line along the length direction LD of the antenna device, and form a line of the antenna device array 300. Preferably, the lines defined by the length direction LD of the antenna device arrays 300 are arranged parallel to each other in a plane.

Figure 12:
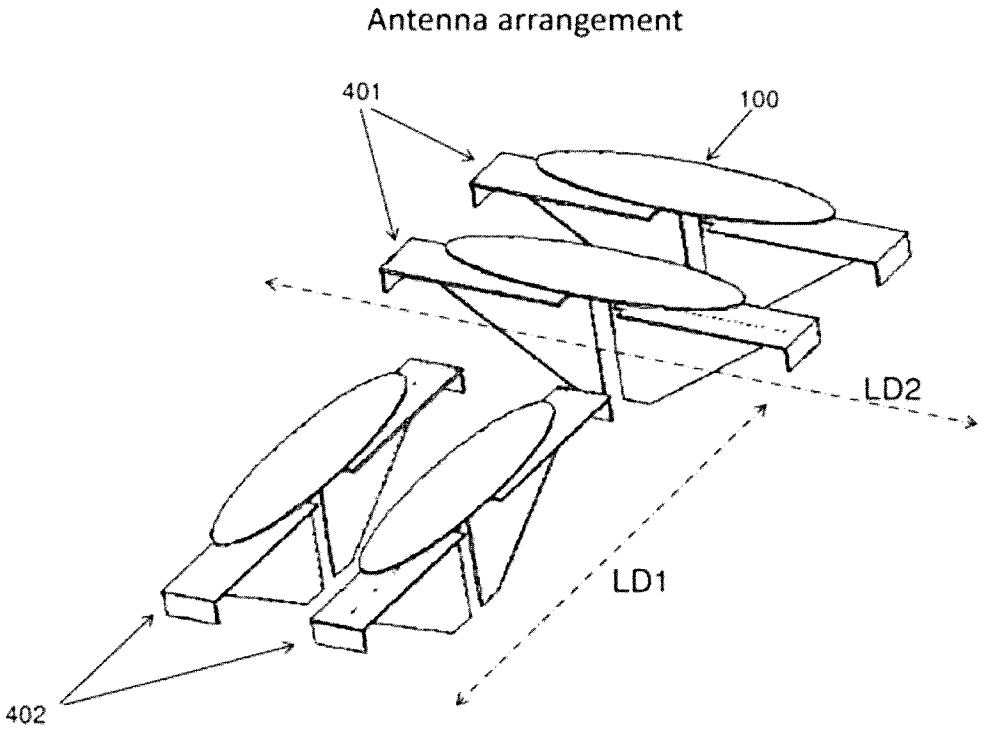
FIG. 12 shows another arrangement of antenna devices according to an embodiment of the present application.

FIG. 12 shows a further arrangement of several antenna devices 100. Accordingly, at least two antenna devices 100 are placed parallel to each other and form an antenna device group 401. Preferably, at least two such antenna device groups 401 and 402 are arranged, so that a length direction LD1 of the antenna device in a first antenna device group 401 is perpendicular to a length direction LD2 of the antenna device in a second antenna device group 402.

Figure 13:
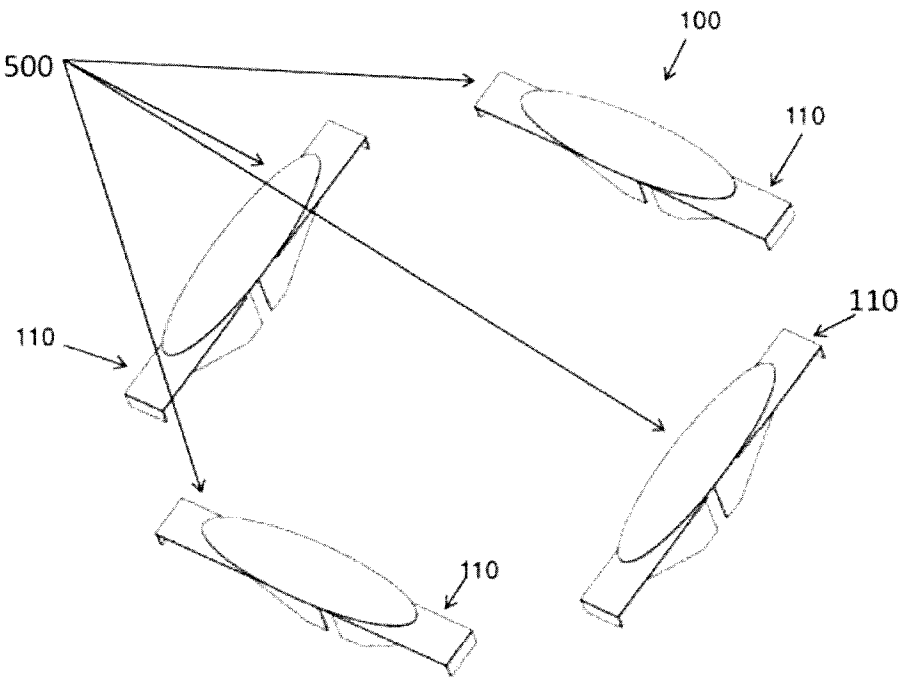
FIG. 13 shows another arrangement of antenna devices according to an embodiment of the present application.

FIG. 13 shows a further arrangement of several antenna devices 100. Accordingly, at least four antenna devices 100 form a rectangular antenna device group and each first radiating element 110 is arranged to be perpendicular to two neighboring first radiating elements, so that the first radiating elements 110 of the at least four antenna devices can form the rectangular antenna device group 500.

Figure 14:
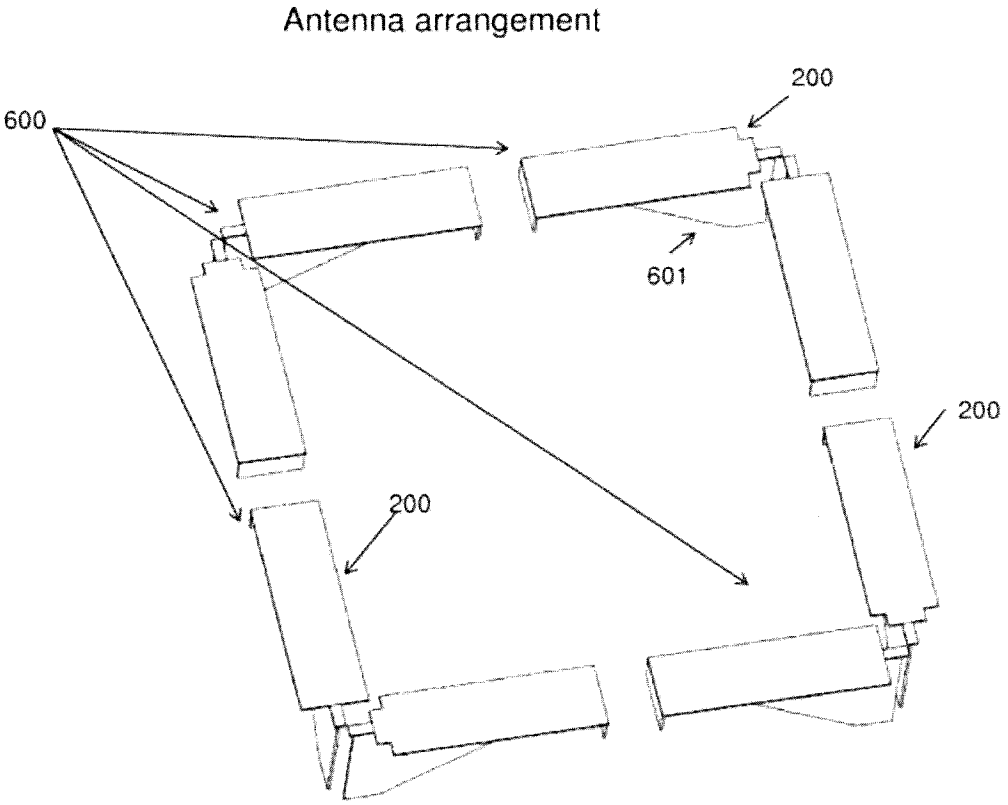
FIG. 14 shows another arrangement of antenna devices according to an embodiment of the present application.

FIG. 14 shows an arrangement of several antenna devices 200 according to FIG. 10. Specially, at least four antenna devices 200 form a rectangular antenna device group 600. Each antenna devices 200 forms a right angle 601 of the rectangular antenna device group 600. Preferably, each first radiating element 110 of the four antenna devices 200 is arranged such that the outer end of the each first radiating element 110 faces and is close to the outer end of a first radiating element 110 of a neighboring antenna device 200.

The proportions between the height H from a reflector to the dipole feet and the length L of dipole anus (the first radiating element 110) are typically 1:4.

Figure 15:
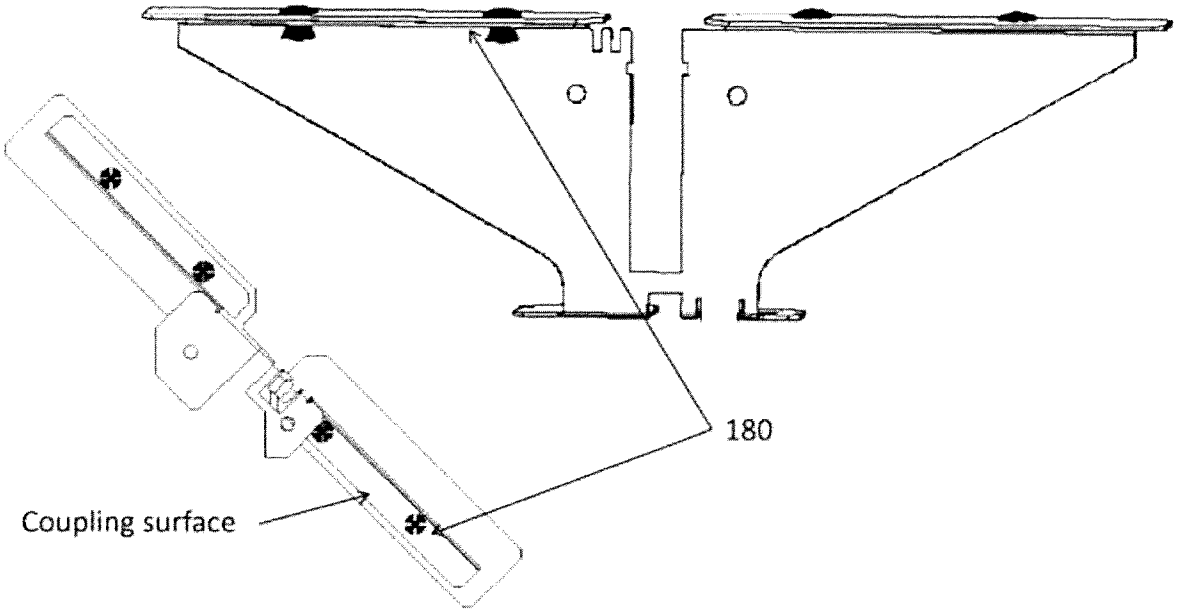
FIG. 15 shows a capacitive connection between the first and the second radiating elements according to an embodiment of the present application.

FIG. 15 shows a possible capacitive coupling 180 between the first radiating element and 110 the second radiating element 120 by using any suitable fastening means. e.g. clip, latch, hook or bolt fastening.

The present application has been described in conjunction with various embodiments as examples as well as implementations. However, other variations can be understood and effected by those persons skilled in the art and practicing the claimed application, from the studies of the drawings, this disclosure and the independent claims. In the claims as well as in the description the word "comprising" does not exclude other elements or steps and the indefinite article "a" or "an" does not exclude a plurality. A single element or other unit may fulfill the functions of several entities or items recited in the claims. The mere fact that certain measures are recited in the mutual different dependent claims does not indicate that a combination of these measures cannot be used in an advantageous implementation.

The invention claimed is:

1. An antenna device comprising:

at least two antenna elements, each antenna element comprising a first radiating element and a corresponding second radiating element;

wherein:

each second radiating element extends in a height direction along a common center axis from a foot of the antenna device to its corresponding first radiating element;

each first radiating element extends in a length direction outwards from the common center axis;

each first radiating element has a length greater than its width;

each first radiating element is electrically coupled to its corresponding second radiating element along the length direction; and for each second radiating element a length of the second radiating element is smaller at the foot as the length at its corresponding first radiating element.

2. The antenna device according to claim 1, wherein the length of each of the first radiating elements is at least two times greater than its width.

3. The antenna device according to claim 1, wherein each of the second radiating elements is planar.

4. The antenna device according to claim 1, wherein each of the first radiating elements comprises a strip portion which extends outwards from the common center axis in the length direction and at least one bent portion which extends in an angle $\varphi$ to the length direction, wherein $10° \leq \varphi \leq 170°$.

5. The antenna device according to claim 1, wherein:

each second radiating element comprises a first edge extending from the foot at least partially along the height direction to a first end of the second radiating element, the first end being arranged comparatively close to the common center axis and being coupled to the corresponding first radiating element; and each second radiating element comprises a second edge extending from the foot to a second end of the second radiating element, the second end being arranged comparatively distant from the common center axis and being coupled to the corresponding first radiating element.

6. The antenna device according to claim 1, wherein each first radiating element of the antenna element comprises a bending edge extending in the length direction and electrically connecting the first radiating element of the antenna element to the corresponding second radiating element of the antenna element.

7. The antenna device according to claim 6, wherein:

each second radiating element comprises an opening extending in the length direction from a first connection point between the second radiating element and the corresponding first radiating element to a second connection point between the second radiating element and the corresponding first radiating element; and an area of the opening is as at least as large as an area of a portion of the first radiating element, the portion extending in the length direction from the first connection point to the second connection point and in a width direction from the bending edge to an edge of the corresponding first radiating element.

8. The antenna device according to claim 1, wherein each antenna element comprises an impedance transformer arranged at a connection point electrically coupling the first radiating element of the antenna element to the corresponding second radiating element of the antenna element.

9. The antenna device according to claim 1, wherein each antenna element is formed in a single piece.

10. The antenna device according to claim 1, further comprising:

an electrically conducting director element being arranged in the height direction above the first radiating elements and being supported by dielectric material arranged between the director element and the first radiating elements.

11. The antenna device according to claim 10, wherein the director element comprises per first radiating element of the antenna element a corresponding arm extending from the common center axis outwards in the same direction as the corresponding first radiating element.

12. The antenna device according to claim 1, wherein the two antenna elements form a first pair of antenna elements and a dipole of the antenna device.

13. The antenna device according to claim 12, further comprising a second pair of antenna elements arranged around the common center axis and forming a second dipole of the antenna device.

14. The antenna device according to claim 13, wherein the pairs of said antenna elements are arranged such that the second radiation elements of a respective pair form a 180° angle and the second radiation elements of two different pairs form a 90° angle.

* * * * *